US012246813B2

(12) United States Patent
Saruwatari et al.

(10) Patent No.: US 12,246,813 B2
(45) Date of Patent: Mar. 11, 2025

(54) OUTBOARD MOTOR

(71) Applicant: YAMAHA HATSUDOKI KABUSHIKI KAISHA, Iwata (JP)

(72) Inventors: Kimitaka Saruwatari, Shizuoka (JP); Tomoya Sako, Shizuoka (JP); Ryo Nakanishi, Shizuoka (JP)

( * ) Notice: Subject to any disclaimer, the term of this patent is extended or adjusted under 35 U.S.C. 154(b) by 524 days.

(21) Appl. No.: 17/848,621

(22) Filed: Jun. 24, 2022

(65) Prior Publication Data

US 2023/0029771 A1 Feb. 2, 2023

(30) Foreign Application Priority Data

Jul. 30, 2021 (JP) ..... 2021-125692

(51) Int. Cl.

| | |
|---|---|
| ***B63H 23/34*** | (2006.01) |
| ***B63H 20/02*** | (2006.01) |
| ***B63H 20/32*** | (2006.01) |
| ***B63H 23/32*** | (2006.01) |

(52) U.S. Cl.

CPC ..... *B63H 23/34* (2013.01); *B63H 20/02* (2013.01); *B63H 20/32* (2013.01); *B63H 23/321* (2013.01)

(58) Field of Classification Search

CPC ..... B63H 23/34; B63H 23/321; B63H 20/02; B63H 20/32

See application file for complete search history.

(56) References Cited

U.S. PATENT DOCUMENTS

| | | | | |
|---|---|---|---|---|
| 1,822,573 | A * | 9/1931 | Anderson | B63H 20/002 440/88 L |
| 7,422,500 | B1 * | 9/2008 | Mansfield | B63H 23/32 440/78 |
| 2004/0092178 | A1 * | 5/2004 | Creighton | B63B 3/42 440/83 |
| 2017/0361911 | A1 * | 12/2017 | Galletta, Jr. | G06F 3/064 |

FOREIGN PATENT DOCUMENTS

JP 2015-067191 A 4/2015

* cited by examiner

*Primary Examiner* — Stephen P Avila
(74) *Attorney, Agent, or Firm* — Keating & Bennett, LLP

(57) ABSTRACT

An outboard motor includes a drive source, a drive shaft, a propeller shaft, a first case, a second case, a third case, a bearing, and a bearing housing. The drive shaft extends downward from the drive source. The propeller shaft is connected to the drive shaft and extends in a front-rear direction of the outboard motor. The first case houses the drive source. The second case houses the propeller shaft. The third case is between the first case and the second case in a vertical direction of the outboard motor. The bearing rotatably supports the drive shaft. The bearing is between the first case and the second case in the vertical direction and outside the third case. The bearing housing supports the bearing. The bearing housing is between the first case and the second case in the vertical direction and outside the third case.

14 Claims, 8 Drawing Sheets

OUTBOARD MOTOR

CROSS REFERENCE TO RELATED APPLICATIONS

This application claims the benefit of priority to Japanese Patent Application No. 2021-125692 filed on Jul. 30, 2021. The entire contents of this application are hereby incorporated herein by reference.

BACKGROUND OF THE INVENTION

1. Field of the Invention

The present invention relates to an outboard motor.

2. Description of the Related Art

An outboard motor includes a drive shaft for transmitting a rotation from a drive source to a propeller shaft. For example, an outboard motor disclosed in Japanese Laid-open Patent Application Publication No. 2015-67191 includes an engine cowl, an upper housing, a lower housing, an engine, a drive shaft, and a propeller shaft. The engine is arranged in the engine cowl. The propeller shaft is arranged in the lower housing. The upper housing is arranged between the engine cowl and the lower housing. The drive shaft extends downward from the engine and is connected to the propeller shaft. A portion of the drive shaft is arranged in the upper housing.

The drive shaft is long in the vertical direction of the outboard motor. Therefore, conventionally, the drive shaft is supported by a bush with rubber in the upper housing in order to suppress runout. For example, the upper housing is an integrally molded product by casting, and the bush is attached to the upper housing by press fitting.

In recent years, a heavy object such as a coupling or a motor may be connected to the drive shaft. Alternatively, it may be desired to increase the diameter of the drive shaft. In that case, if the shape of the bush that supports the drive shaft is changed, the common case cannot be used as it is. Therefore, additional processing to the case is required, which complicates the manufacturing process.

SUMMARY OF THE INVENTION

Preferred embodiments of the present invention each facilitate correspondence to various specifications of drive shafts in outboard motors and simplify the manufacturing process thereof.

An outboard motor according to a preferred embodiment of the present invention includes a drive source, a drive shaft, a propeller shaft, a first case, a second case, a third case, a bearing, and a bearing housing. The drive shaft extends downward from the drive source. The propeller shaft is connected to the drive shaft and extends in a front-rear direction of the outboard motor. The first case houses the drive source. The second case houses the propeller shaft. The third case is between the first case and the second case in a vertical direction of the outboard motor. The bearing rotatably supports the drive shaft. The bearing is between the first case and the second case in the vertical direction and outside the third case. The bearing housing supports the bearing. The bearing housing is between the first case and the second case in the vertical direction and outside the third case.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
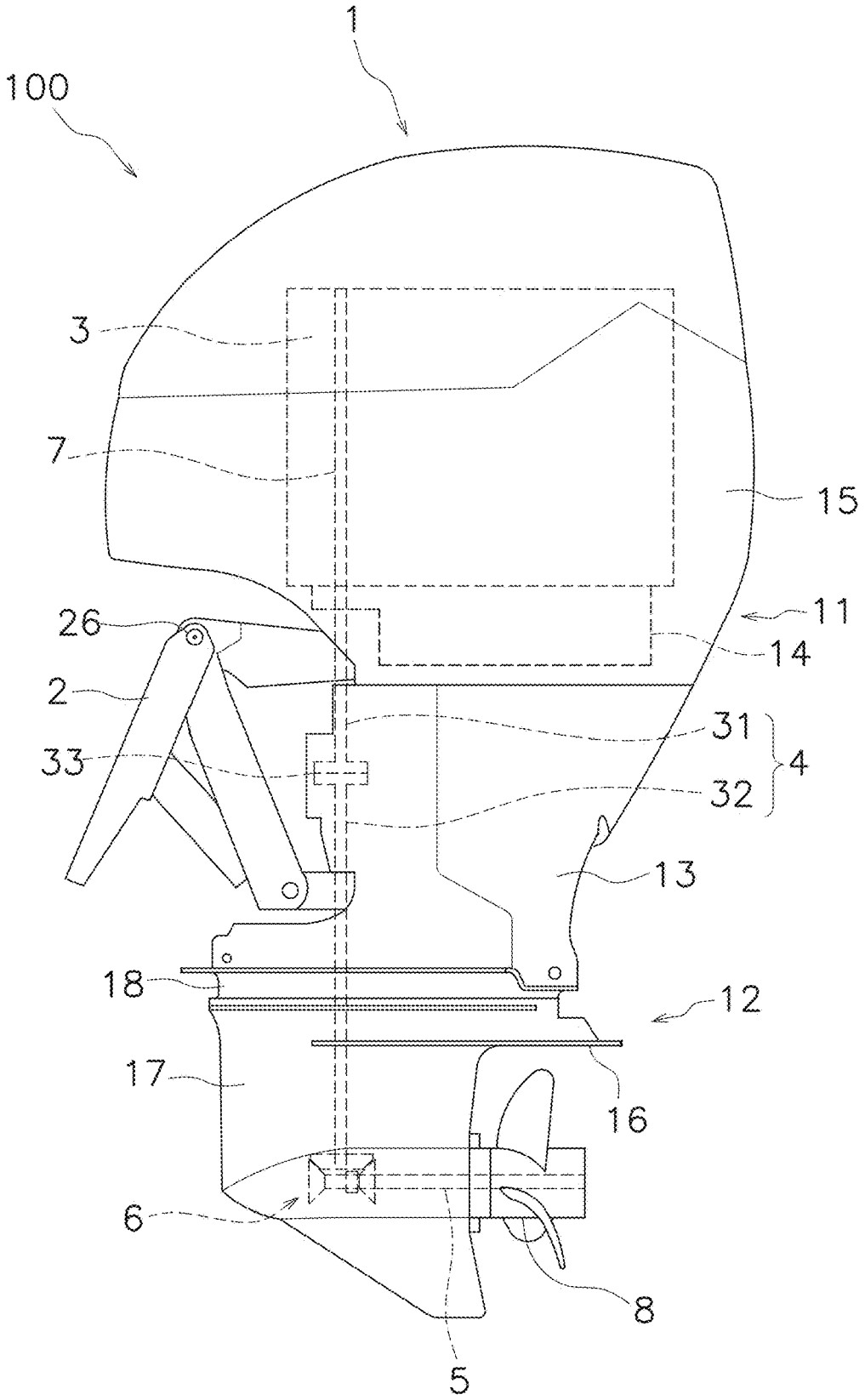
FIG. 1 is a side view of an outboard motor according to a preferred embodiment of the present invention.

Hereinafter, preferred embodiments will be described with reference to the drawings. FIG. 1 is a side view of an outboard motor 100 according to a preferred embodiment of the present invention. The outboard motor 100 includes an outboard motor body 1 and a bracket 2. The outboard motor body 1 is attached to a marine vessel via the bracket 2. The bracket 2 is connected to the outboard motor body 1. The bracket 2 is attached to the marine vessel. The outboard motor body 1 includes a drive source 3, a drive shaft 4, a propeller shaft 5, and a shift mechanism 6.

The drive source 3 generates a thrust that propels the marine vessel. The drive source 3 is an internal combustion engine, for example. The drive source 3 includes a crank shaft 7. The crank shaft 7 extends in a vertical direction of the outboard motor 100. The drive shaft 4 is connected to the crank shaft 7. The drive shaft 4 extends in the vertical direction of the outboard motor 100. The drive shaft 4 extends downward from the drive source 3.

The propeller shaft 5 extends in a front-rear direction of the outboard motor 100. The propeller shaft 5 is connected to the drive shaft 4 via the shift mechanism 6. A propeller 8 is attached to the propeller shaft 5. The shift mechanism 6 includes a plurality of gears and a clutch. The shift mechanism 6 switches the transmission direction of rotation from the drive shaft 4 to the propeller shaft 5. As a result, the forward and reverse directions of the marine vessel are switched.

The outboard motor body 1 includes a first case 11, a second case 12, and an exterior cover 13. The first case 11 houses the drive source 3. The first case 11 includes a base 14 and a cowl 15. The drive source 3 is arranged on the base 14. The base 14 supports the drive source 3. The cowl 15 covers the base 14 and the drive source 3. The cowl 15 is made of resin, for example. Alternatively, the cowl 15 may be made of metal such as aluminum or stainless steel.

The second case 12 is arranged below the first case 11. The second case 12 houses the propeller shaft 5 and the shift mechanism 6. The second case 12 is made of metal such as aluminum or stainless steel. The second case 12 includes a cavitation plate 16 projecting rearward. The second case 12 includes a lower case 17 and an attachment 18. The attachment 18 is arranged on the lower case 17. The attachment 18 is attached to the lower case 17.

Figure 2:
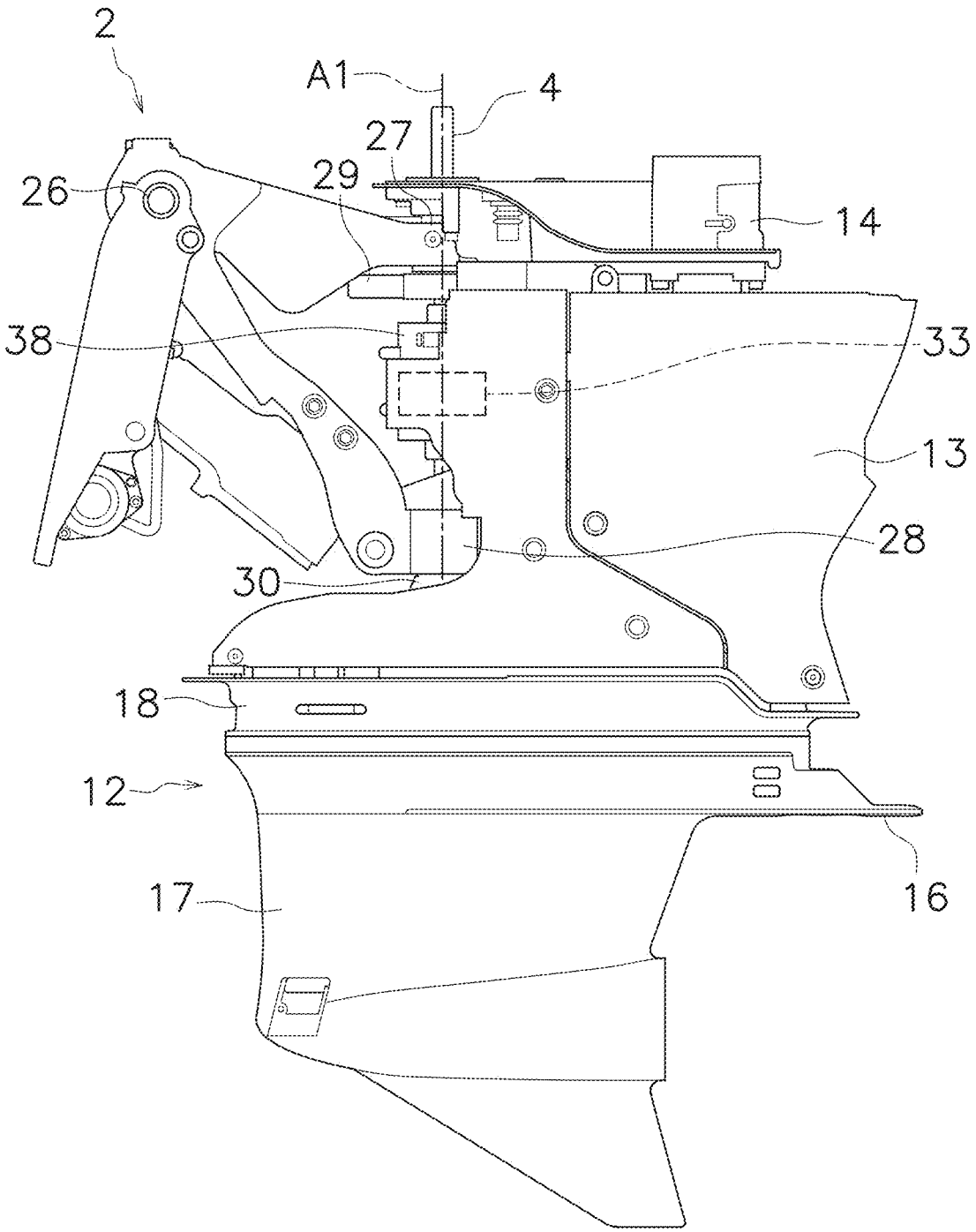
FIG. 2 is a side view of a lower portion of the outboard motor.
Figure 3:
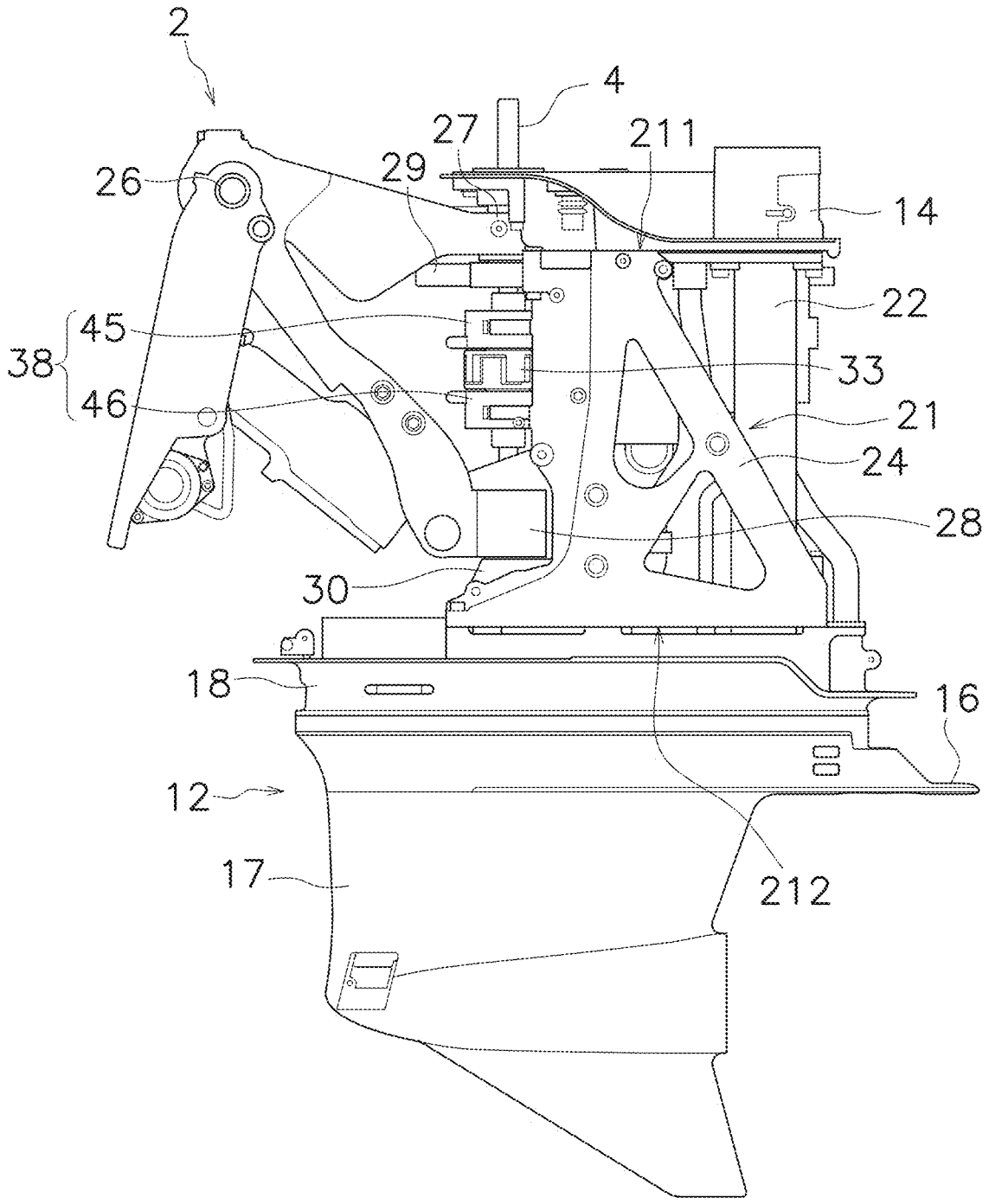
FIG. 3 is a side view of the lower portion of the outboard motor from which an exterior cover has been removed.

FIG. 2 is a side view of a lower portion of the outboard motor 100. FIG. 3 is a side view of the lower portion of the outboard motor 100 from which the exterior cover 13 has been removed. As shown in FIG. 3, the outboard motor body 1 includes a third case 21. The third case 21 is arranged in the exterior cover 13. The exterior cover 13 covers the third case 21 from the outside. The exterior cover 13 is made of, for example, resin. However, the exterior cover 13 may be made of metal such as aluminum or stainless steel. The exterior cover 13 covers the third case 21 from the lateral side.

Figure 4:
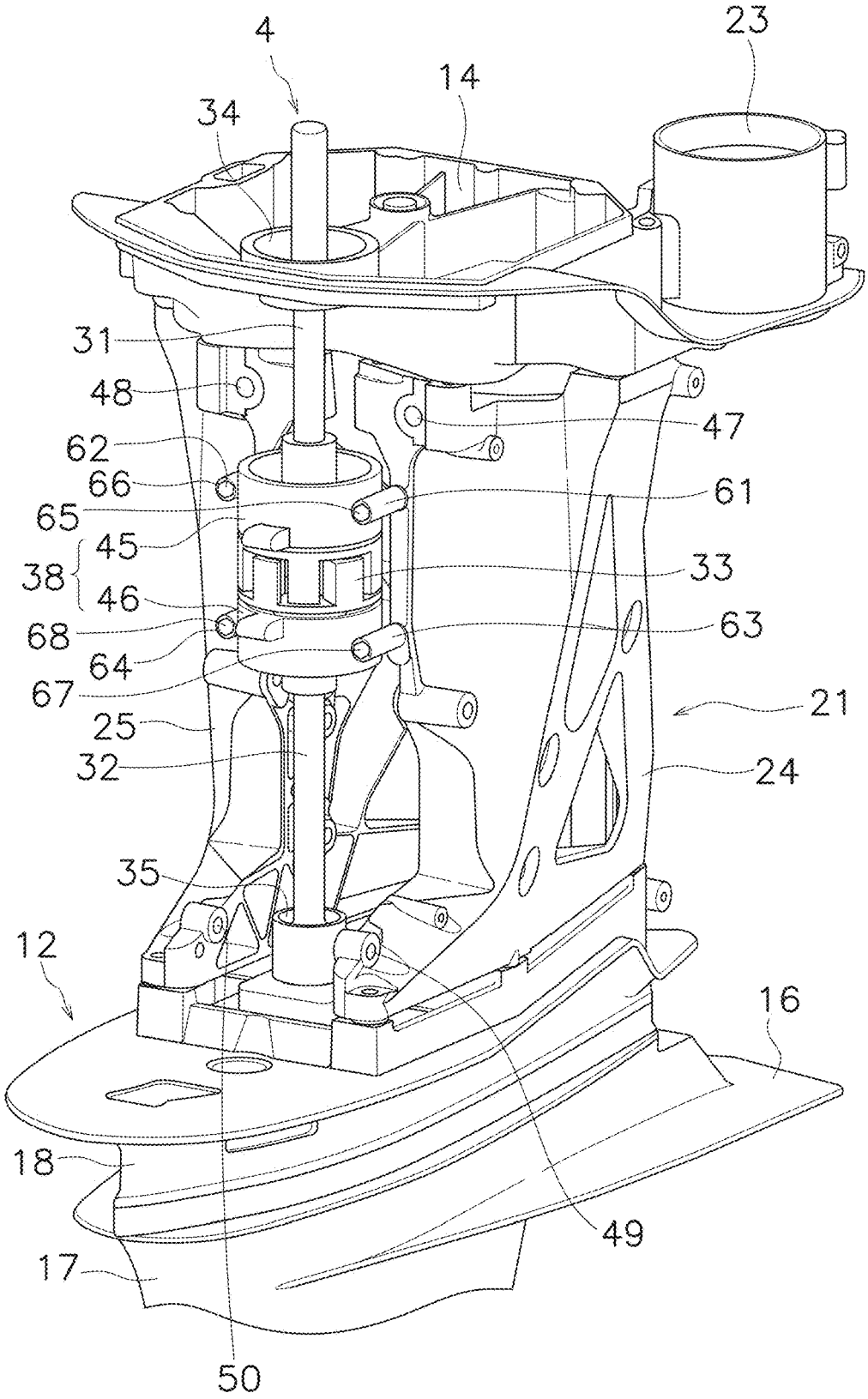
FIG. 4 is a perspective view of the lower portion of the outboard motor from which the exterior cover and a bracket have been removed.
Figure 5:
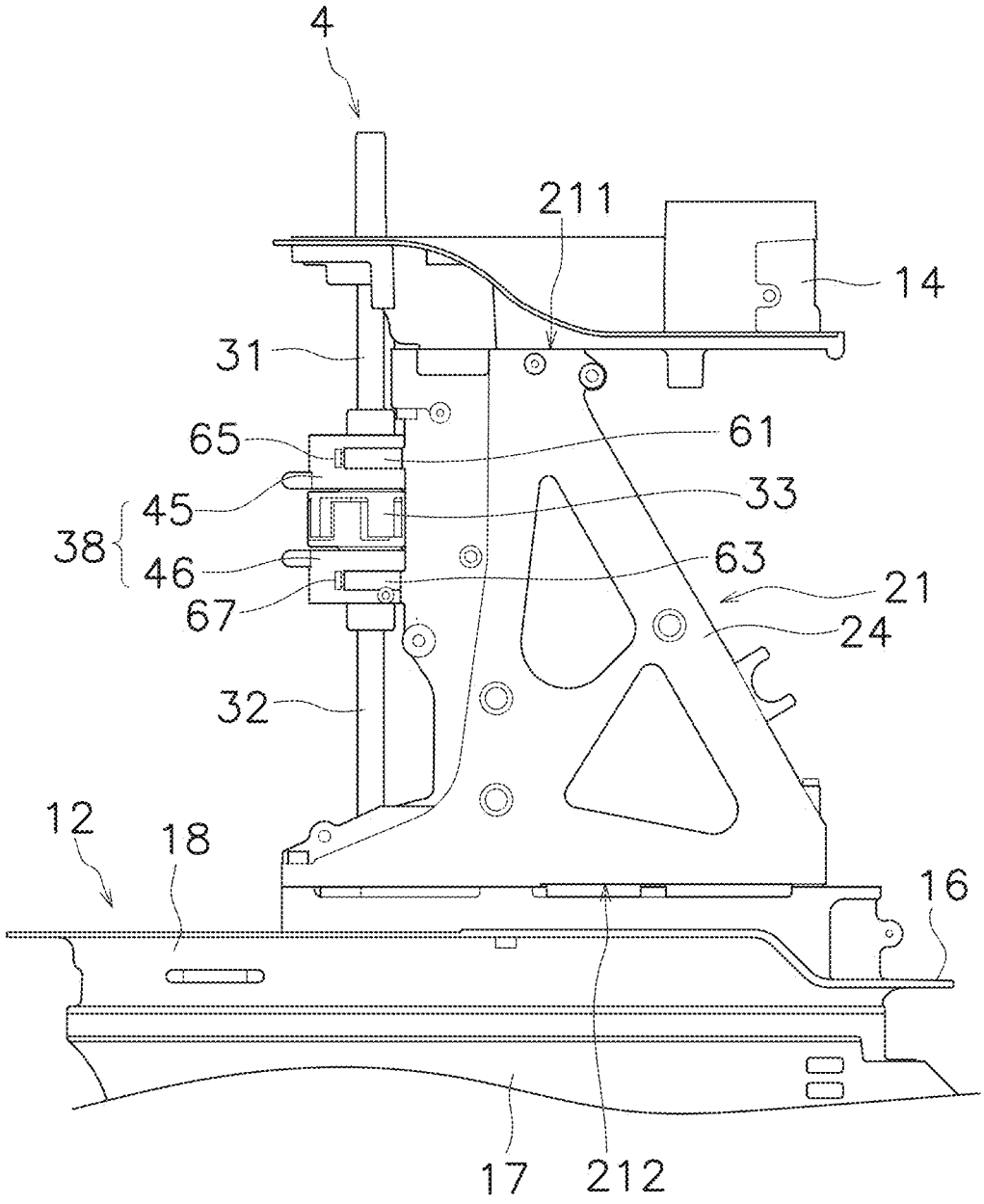
FIG. 5 is a side view of the lower portion of the outboard motor from which the exterior cover and the bracket have been removed.
Figure 6:
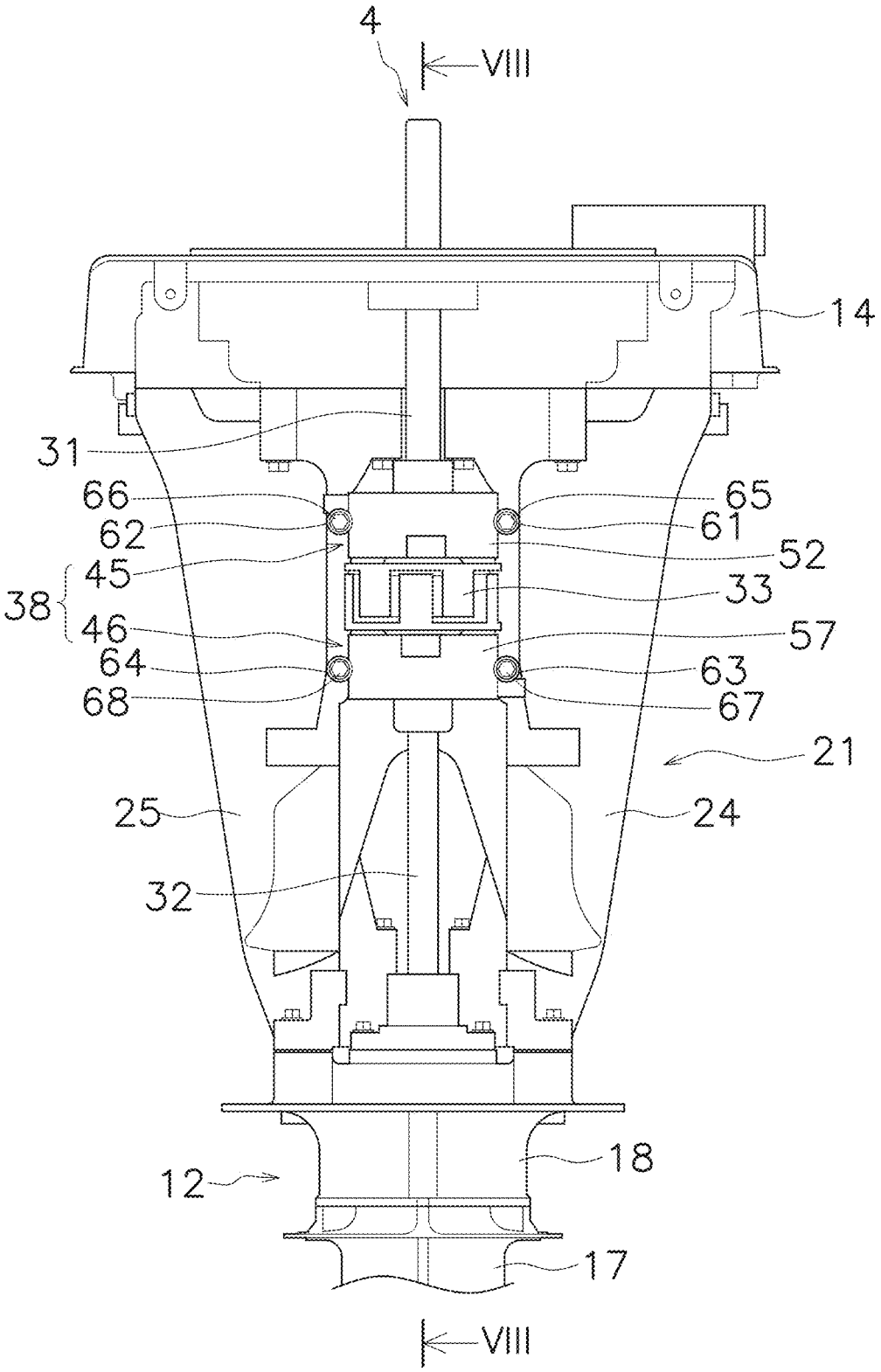
FIG. 6 is a front view of the lower portion of the outboard motor from which the exterior cover and the bracket have been removed.
Figure 7:
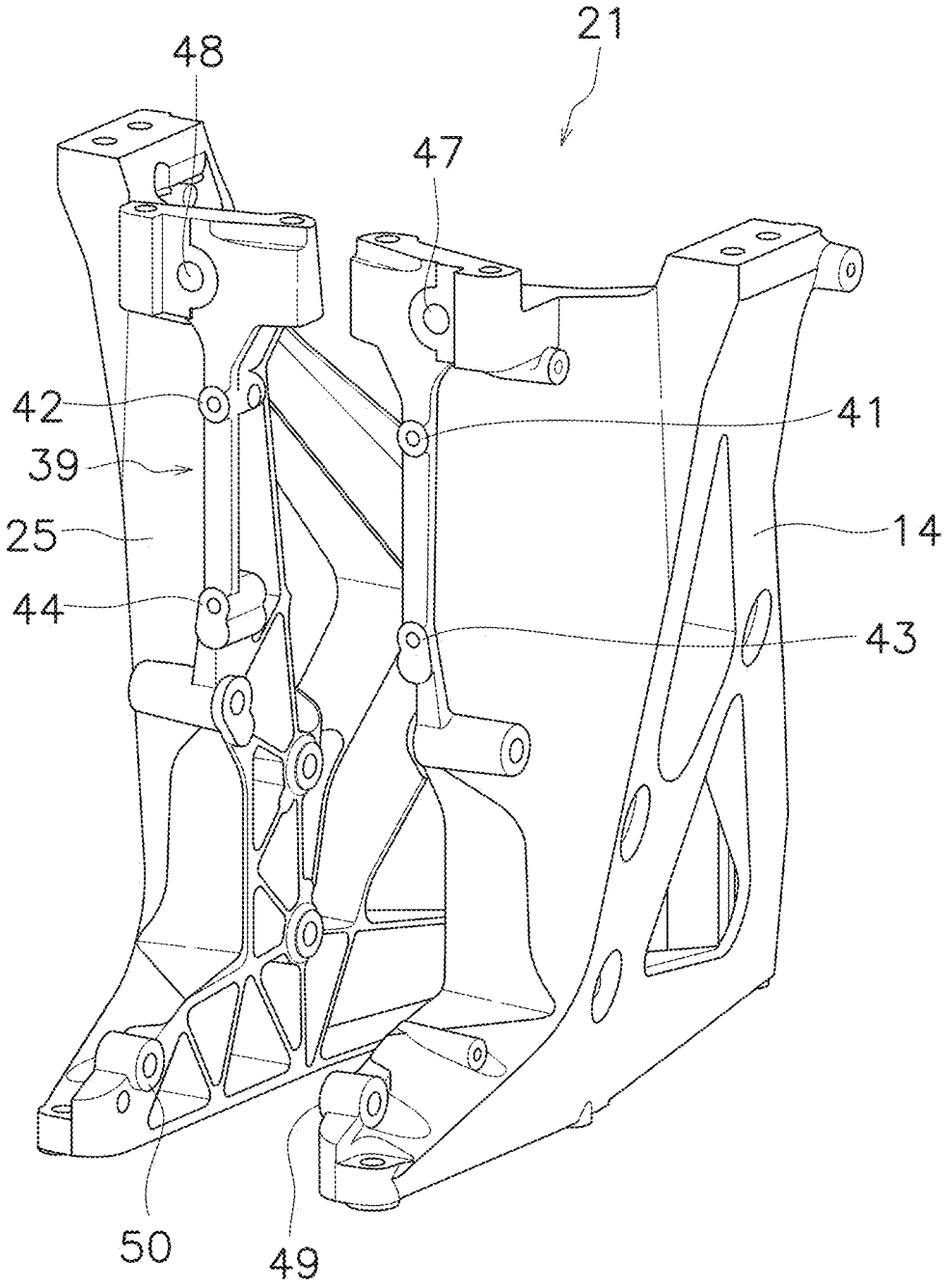
FIG. 7 is a perspective view of a third case.

FIG. 4 is a perspective view of the lower portion of the outboard motor 100 from which the exterior cover 13 and the bracket 2 have been removed. FIG. 5 is a side view of the lower portion of the outboard motor 100 from which the exterior cover 13 and the bracket 2 have been removed. FIG. 6 is a front view of the lower portion of the outboard motor 100 from which the exterior cover 13 and the bracket 2 have been removed. FIG. 7 is a perspective view of the third case 21.

As shown in FIGS. 3 to 7, the third case 21 is arranged between the first case 11 and the second case 12 in the vertical direction. The base 14 is arranged on the third case 21. The base 14 is attached to the third case 21. The third case 21 is arranged on the second case 12. The third case 21 is attached to the second case 12. The third case 21 is made of metal such as aluminum or stainless steel.

As shown in FIG. 3, the outboard motor body 1 includes an exhaust pipe 22. The exhaust pipe 22 is connected to the drive source 3. As shown in FIG. 4, the base 14 includes a hole 23. The exhaust pipe 22 extends downward from the drive source 3 through the hole 23 of the base 14. At least a portion of the exhaust pipe 22 is arranged in the third case 21. As seen in the side view of the outboard motor 100, at least a portion of the exhaust pipe 22 overlaps with the third case 21.

As shown in FIG. 7, the third case 21 includes a left case 24 and a right case 25. The left case 24 and the right case 25 are separate bodies from each other. The left case 24 and the right case 25 are arranged apart from each other in a left-right direction of the outboard motor 100. The exhaust pipe 22 extends between the left case 24 and the right case 25.

As shown in FIG. 2, the bracket 2 rotatably supports the outboard motor body 1 around a steering axis A1. The steering axis A1 extends in the vertical direction of the outboard motor 100. The steering axis A1 is arranged concentrically with the drive shaft 4. However, the steering axis A1 may be arranged away from the drive shaft 4. The bracket 2 includes a tilt shaft 26. The tilt shaft 26 extends in the left-right direction of the outboard motor 100. The tilt shaft 26 is rotatably supported by the marine vessel.

The bracket 2 includes a first connector 27 and a second connector 28. The first connector 27 and the second connector 28 are connected to the outboard motor body 1. The first connector 27 and the second connector 28 are arranged apart from each other in the vertical direction. The second connector 28 is arranged below the first connector 27. The first connector 27 is rotatably supported by the third case 21 around the steering axis A1. The second connector 28 is rotatably supported by the third case 21 around the steering axis A1.

As shown in FIG. 3, the first connector 27 is supported by the third case 21 via the first support member 29. The first support member 29 rotatably supports the first connector 27 around the steering axis A1. The first support member 29 is attached to the third case 21. As shown in FIG. 4, the third case 21 includes a first upper mount 47 and a second upper mount 48. The first support member 29 is attached to the first upper mount 47 and the second upper mount 48. The first upper mount 47 is provided on the left case 24. The second upper mount 48 is provided on the right case 25.

The second connector 28 is supported by the third case 21 via the second support member 30. The second support member 30 rotatably supports the second connector 28 around the steering axis A1. The second support member 30 is attached to the third case 21. The third case 21 includes a first lower mount 49 and a second lower mount 50. The second support member 30 is attached to the first lower mount 49 and the second lower mount 50. The first lower mount 49 is provided on the left case 24. The second lower mount 50 is provided on the right case 25.

As shown in FIG. 4, the drive shaft 4 includes a first shaft 31 and a second shaft 32. The first shaft 31 and the second shaft 32 are separate bodies from each other. A predetermined component 33 is attached to the drive shaft 4. The predetermined component 33 is a coupling, for example. The first shaft 31 and the second shaft 32 are connected to each other by the predetermined component 33. By removing the predetermined component 33, the first shaft 31 and the second shaft 32 are able to be separated from each other.

The first shaft 31 is arranged above the predetermined component 33. The first shaft 31 extends upward from the predetermined component 33. The first shaft 31 extends through the first case 11 and is connected to the drive source 3. Specifically, as shown in FIG. 4, the base 14 includes a hole 34. The first shaft 31 extends into the first case 11 through the hole 34 of the base 14.

The second shaft 32 is arranged below the predetermined component 33. The second shaft 32 extends downward from the predetermined component 33. The second shaft 32 passes through the second case 12 and is connected to the shift mechanism 6. Specifically, as shown in FIG. 4, the attachment 18 includes a hole 35. The hole 35 is provided on an upper surface of the attachment 18. The hole 35 of the attachment 18 is arranged between the left case 24 and the right case 25 in the left-right direction. The second shaft 32 extends into the second case 12 through the hole 35 of the attachment 18.

An outer shape of the predetermined component 33 is larger than an outer diameter of the first shaft 31. The outer shape of the predetermined component 33 is larger than an outer diameter of the second shaft 32. That is, the predetermined component 33 is thicker than the first shaft 31. The predetermined component 33 is thicker than the second shaft 32. The predetermined component 33 is arranged between the first case 11 and the second case 12 in the vertical direction.

As shown in FIG. 5, the predetermined component 33 is arranged lower than an upper end 211 of the third case 21. The predetermined component 33 is arranged higher than a lower end 212 of the third case 21. The predetermined component 33 is arranged outside the third case 21. The predetermined component 33 is arranged in front of the third case 21. As shown in FIG. 2, as seen in the side view of the outboard motor 100, at least a portion of the predetermined component 33 is covered with the exterior cover 13.

Figure 8:
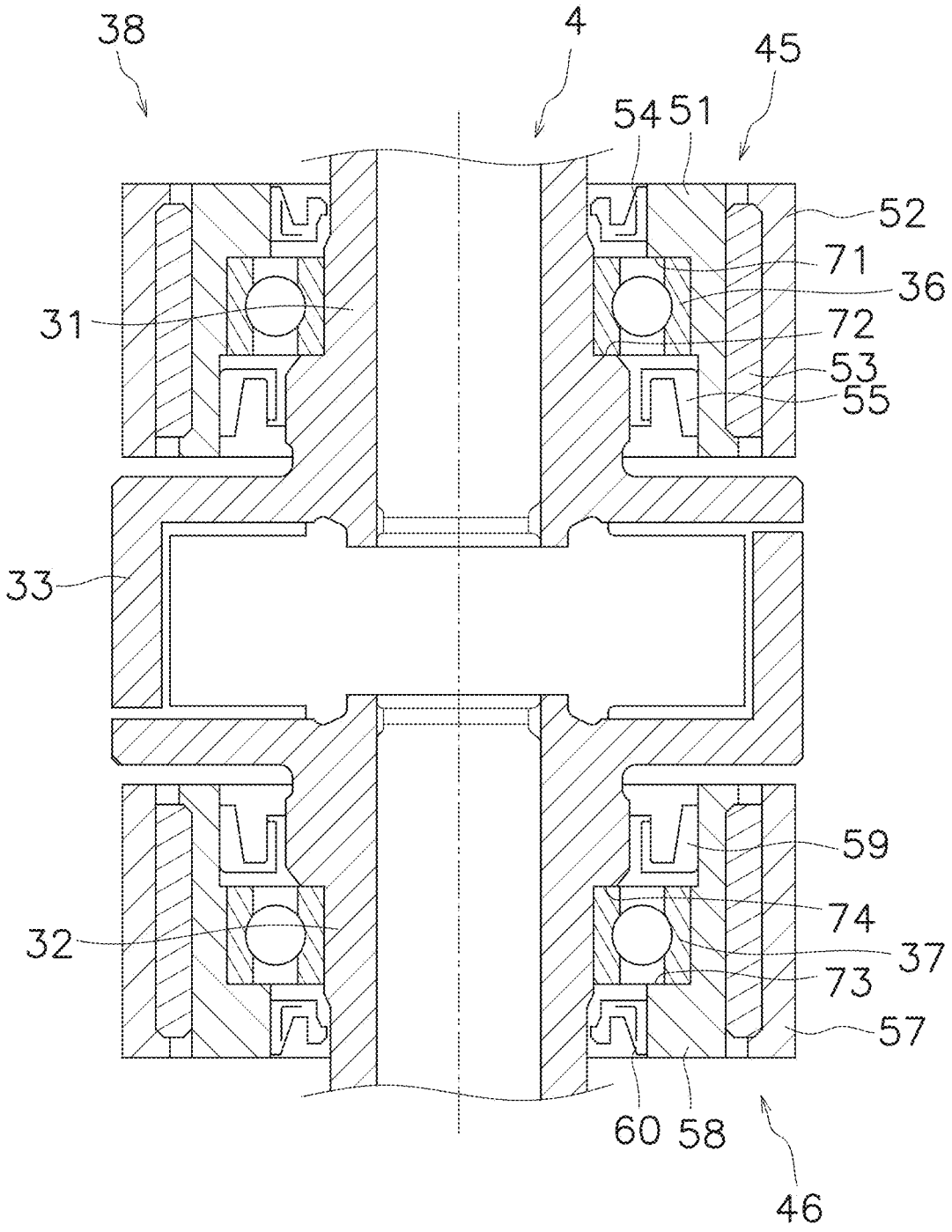
FIG. 8 is a sectional view taken along line VIII-VIII of a drive shaft and a predetermined component in FIG. 6.

FIG. 8 is a sectional view taken along line VIII-VIII of the drive shaft 4 and the predetermined component 33 in FIG. 4. As shown in FIG. 8, the outboard motor body 1 includes bearings 36 and 37 and a bearing housing 38. The bearings 36 and 37 rotatably support the drive shaft 4. The bearings 36 and 37 are arranged between the first case 11 and the second case 12 in the vertical direction. The bearings 36 and 37 are arranged outside the third case 21. The bearings 36 and 37 are arranged in front of the third case 21.

The bearings 36 and 37 include a first bearing 36 and a second bearing 37. The first bearing 36 is arranged above the predetermined component 33. The first bearing 36 rotatably supports the first shaft 31. The second bearing 37 is arranged below the predetermined component 33. The second bearing 37 rotatably supports the second shaft 32.

The bearing housing 38 houses the bearings 36 and 37. The bearing housing 38 is arranged radially outward of the bearings 36 and 37. The bearing housing 38 supports the bearings 36 and 37. The bearing housing 38 is arranged between the first case 11 and the second case 12 in the vertical direction. The bearing housing 38 is arranged outside the third case 21.

The bearing housing 38 is arranged in front of the third case 21. As shown in FIG. 2, at least a portion of the bearing housing 38 is covered with the exterior cover 13. A portion of the bearing housing 38 is not covered by the exterior cover 13 and is exposed to the outside. However, the entire bearing housing 38 may be covered with the exterior cover 13.

At least a portion of the bearing housing 38 is arranged between the tilt shaft 26 and the cavitation plate 16 in the vertical direction. At least a portion of the bearing housing 38 is arranged lower than a center in the vertical direction between the tilt shaft 26 and the cavitation plate 16. At least a portion of the bearing housing 38 is arranged between the first connector 27 and the second connector 28 in the vertical direction. At least a portion of the bearing housing 38 is arranged between the first and second upper mounts 47 and 48 and the first and second lower mounts 49 and 50 in the vertical direction.

The bearing housing 38 is a separate body from the third case 21. The bearing housing 38 is attached to the third case 21. Specifically, as shown in FIG. 7, the third case 21 includes a fixing portion 39 to fix the bearing housing 38. The fixing portion 39 is arranged on a surface of the third case 21. The fixing portion 39 is arranged on a front surface of the third case 21. The bearing housing 38 is detachably fixed to the fixing portion 39. The bearing housing 38 is fixed to the fixing portion 39 by bolts, for example.

Specifically, the fixing portion 39 includes a first upper fixing portion 41, a second upper fixing portion 42, a first lower fixing portion 43, and a second lower fixing portion 44. The first upper fixing portion 41 and the second upper fixing portion 42 are arranged apart from each other in the left-right direction. The first lower fixing portion 43 and the second lower fixing portion 44 are arranged apart from each other in the left-right direction. The first upper fixing portion 41 and the first lower fixing portion 43 are arranged apart from each other in the vertical direction. The first upper fixing portion 41 and the first lower fixing portion 43 are provided on the left case 24. The second upper fixing portion 42 and the second lower fixing portion 44 are arranged apart from each other in the vertical direction. The second upper fixing portion 42 and the second lower fixing portion 44 are provided on the right case 25.

The bearing housing 38 includes a first bearing housing 45 and a second bearing housing 46. The first bearing housing 45 and the second bearing housing 46 are separate bodies from each other. The first bearing housing 45 is arranged above the predetermined component 33. The first bearing housing 45 accommodates the first bearing 36. The second bearing housing 46 is arranged below the predetermined component 33. The second bearing housing 46 accommodates the second bearing 37.

As shown in FIG. 8, the first bearing housing 45 includes a first inner housing 51, a first outer housing 52, and a first elastic body 53. The first inner housing 51 is in contact with the first bearing 36. The first bearing 36 is arranged between the first inner housing 51 and the first shaft 31. The first outer housing 52 is arranged on an outer peripheral side of the first inner housing 51.

The first inner housing 51 includes a first housing step 71. The first housing step 71 projects radially inward from an inner surface of the first inner housing 51. The first shaft 31 includes a first shaft step 72. The first shaft step 72 projects radially outward from an outer peripheral surface of the first shaft 31. The first bearing 36 is arranged between the first housing step 71 and the first shaft step 72 in the vertical direction. The first bearing 36 is prevented from coming off in the vertical direction by the first housing step 71 and the first shaft step 72.

The first elastic body 53 is made of an elastic material such as rubber. The first elastic body 53 is arranged between the first inner housing 51 and the first outer housing 52. Due to the elastic deformation of the first elastic body 53, the first inner housing 51 is able to move relative to the first outer housing 52 in the axial direction of the drive shaft 4. Therefore, the first bearing housing 45 movably supports the first bearing 36 in the axial direction of the drive shaft 4. By elastically deforming the first elastic body 53, the first inner housing 51 is able to move relative to the first outer housing 52 in the radial direction of the drive shaft 4. Therefore, the first bearing housing 45 movably supports the first bearing 36 in the radial direction of the drive shaft 4.

The first bearing housing 45 includes a first upper seal 54 and a first lower seal 55. The first upper seal 54 is arranged above the first bearing 36. The first lower seal 55 is arranged below the first bearing 36. The first upper seal 54 and the first lower seal 55 seal a space between the first inner housing 51 and the first bearing 36. The space between the first inner housing 51 and the first bearing 36 is filled with a lubricant such as grease.

The second bearing housing 46 preferably has the same structure as the first bearing housing 45. Specifically, the second bearing housing 46 includes a second inner housing 56, a second outer housing 57, and a second elastic body 58. The second inner housing 56 is in contact with the second bearing 37. The second bearing 37 is arranged between the second inner housing 56 and the second shaft 32. The second outer housing 57 is arranged on an outer peripheral side of the second inner housing 56.

The second inner housing 56 includes a second housing step 73. The second housing step 73 projects radially inward from an inner surface of the second inner housing 56. The second shaft 32 includes a second shaft step 74. The second shaft step 74 projects radially outward from an outer peripheral surface of the second shaft 32. The second bearing 37 is arranged between the second housing step 73 and the second shaft step 74 in the vertical direction. The second bearing 37 is prevented from coming off in the vertical direction by the second housing step 73 and the second shaft step 74.

The second elastic body 58 is made of an elastic material such as rubber. The second elastic body 58 is arranged between the second inner housing 56 and the second outer housing 57. Due to the elastic deformation of the second elastic body 58, the second inner housing 56 is able to move relative to the second outer housing 57 in the axial direction of the drive shaft 4. Therefore, the second bearing housing 46 movably supports the second bearing 37 in the axial direction of the drive shaft 4. Due to the elastic deformation of the second elastic body 58, the second inner housing 56 is able to move relative to the second outer housing 57 in the radial direction of the drive shaft 4. Therefore, the second bearing housing 46 movably supports the second bearing 37 in the radial direction of the drive shaft 4.

The second bearing housing 46 includes a second upper seal 59 and a second lower seal 60. The second upper seal 59 is arranged above the second bearing 37. The second lower seal 60 is arranged below the second bearing 37. The second upper seal 59 and the second lower seal 60 seal a space between the second inner housing 56 and the second bearing 37. The space between the second inner housing 56 and the second bearing 37 is filled with a lubricant such as grease.

As shown in FIG. 4, the first bearing housing 45 includes a first upper boss 61 and a second upper boss 62. As shown in FIG. 6, the first upper boss 61 and the second upper boss 62 are connected to the first outer housing 52. The first upper boss 61 is arranged on the left side of the first outer housing 52. The second upper boss 62 is arranged on the right side of the first outer housing 52. The first upper boss 61 and the second upper boss 62 are detachably attached to the third case 21 by bolts 65 and 66, for example.

Specifically, the first upper boss 61 is fixed to the first upper fixing portion 41 of the third case 21 by the bolt 65. The second upper boss 62 is fixed to the second upper fixing portion 42 of the third case 21 by the bolt 66. As a result, the first bearing housing 45 is detachably attached to the third case 21.

The second bearing housing 46 includes a first lower boss 63 and a second lower boss 64. The first lower boss 63 and the second lower boss 64 are connected to the second outer housing 57. The first lower boss 63 is arranged on the left side of the second outer housing 57. The second lower boss 64 is arranged on the right side of the second outer housing 57. The first lower boss 63 and the second lower boss 64 are detachably attached to the third case 21 by bolts 67 and 68, for example.

Specifically, the first lower boss 63 is fixed to the first lower fixing portion 43 of the third case 21 by the bolt 67. The second lower boss 64 is fixed to the second lower fixing portion 44 of the third case 21 by the bolt 68. As a result, the second bearing housing 46 is detachably attached to the third case 21.

In the outboard motor 100 according to the present preferred embodiment, the bearing housing 38 is arranged between the first case 11 and the second case 12 in the vertical direction and outside the third case 21. Therefore, drive shafts having different specifications are able to be supported via the bearing housing 38 without additional processing to the third case 21. As a result, it is easy to meet various specifications of the drive shaft 4, and the manufacturing process is able to be simplified. Further, the bearing housing 38 is attached to the third case 21 from the outside of the third case 21. Therefore, the ease of assembly of the outboard motor 100 is improved.

The bearing housing 38 movably supports the bearings 36 and 37. Therefore, even if the drive shaft 4 is displaced from the mounting position of the drive shaft 4 in the first case 11 at the time of assembling the outboard motor 100, the drive shaft 4 is able to be easily assembled to the first case 11.

Since the bearing housing 38 is arranged outside the third case 21, access to the bearing housing 38 is easy. Therefore, for example, maintenance work such as replenishing the bearing housing 38 with lubricating oil is able to be easily performed without removing the drive shaft 4. As a result, maintainability is improved.

Although preferred embodiments of the present invention have been described above, the present invention is not limited to the above preferred embodiments, and various modifications can be made without departing from the gist of the present invention.

The structure of the outboard motor 100 is not limited to that of the above preferred embodiments, and may be modified. For example, the drive source 3 is not limited to the internal combustion engine, and may be an electric motor. Alternatively, the drive source 3 may be a hybrid of an internal combustion engine and an electric motor.

The structure of the first case 11, the second case 12, or the third case 21 is not limited to that of the above preferred embodiments, and may be modified. For example, the lower case 17 and the attachment 18 may be integral. The left case 24 and the right case 25 may be integral. The third case 21 may be a cast product. In that case, the exhaust passage may be located inside the third case 21 instead of the exhaust pipe 22 of the above preferred embodiments.

The predetermined component 33 is not limited to the coupling, and may be another component such as a generator. The position of the predetermined component 33 is not limited to the front of the third case 21, and may be arranged on a lateral side or rearward of the third case 21. Alternatively, the predetermined component 33 may be omitted.

The positions of the bearings 36 and 37 and the bearing housing 38 are not limited to those of the above preferred embodiments, and may be changed. For example, the bearings 36 and 37 and the bearing housing 38 are not limited to the front of the third case 21, but may be arranged on a lateral side or rearward of the third case 21. At least a portion of the bearing housing 38 may be arranged higher than the center in the vertical direction between the tilt shaft 26 and the cavitation plate 16.

The structure of the bearings 36 and 37 and the bearing housing 38 is not limited to that of the above preferred embodiments, and may be modified. For example, the first bearing housing 45 and the second bearing housing 46 are not limited to separate bodies, but may be integrated. The number of bearings 36 and 37 is not limited to two, and may be one or more than two.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a drive source;

a drive shaft extending downward from the drive source;

a propeller shaft connected to the drive shaft and extending in a front-rear direction of the outboard motor;

a first case accommodating the drive source;

a second case accommodating the propeller shaft;

a third case between the first case and the second case in a vertical direction of the outboard motor;

a bearing between the first case and the second case in the vertical direction and outside the third case and rotatably supporting the drive shaft; and a bearing housing between the first case and the second case in the vertical direction and outside the third case and supporting the bearing.

2. The outboard motor according to claim 1, wherein the bearing housing is a separate body from the third case; and the bearing housing is attached to the third case.

3. The outboard motor according to claim 2, wherein the third case includes a fixing portion to fix the bearing housing; and the fixing portion is on a surface of the third case.

4. The outboard motor according to claim 3, wherein the bearing housing is fixed to the fixing portion by a bolt.

5. The outboard motor according to claim 1, wherein the drive source is an engine;

the outboard motor further comprises an exhaust pipe extending downward from the drive source; and at least a portion of the exhaust pipe is in the third case.

6. The outboard motor according to claim 1, further comprising:

an exterior cover to cover at least a portion of the third case.

7. The outboard motor according to claim 1, wherein the bearing housing movably supports the bearing in an axial direction of the drive shaft.

8. The outboard motor according to claim 1, wherein the bearing housing movably supports the bearing in a radial direction of the drive shaft.

9. The outboard motor according to claim 1, wherein the bearing housing includes:

an inner housing in contact with the bearing;

an outer housing on an outer peripheral side of the inner housing; and an elastic body between the inner housing and the outer housing.

10. The outboard motor according to claim 1, further comprising:

a predetermined component between the first case and the second case in the vertical direction and connected to the drive shaft.

11. The outboard motor according to claim 10, wherein the drive shaft includes:

a first shaft above the predetermined component; and a second shaft below the predetermined component; wherein a maximum outer shape of the predetermined component is larger than at least one of an outer diameter of the first shaft and an outer diameter of the second shaft.

12. The outboard motor according to claim 11, wherein the bearing is at least either above or below the predetermined component.

13. The outboard motor according to claim 1, further comprising:

a bracket to be attached to a marine vessel; wherein the bracket includes a tilt shaft rotatably supported by the marine vessel;

the second case includes a cavitation plate that projects rearward; and at least a portion of the bearing housing is between the tilt shaft and the cavitation plate.

14. The outboard motor according to claim 1, further comprising:

an outboard motor body including the first case, the second case, and the third case; and a bracket connected to the outboard motor body to attach the outboard motor to a marine vessel; wherein the bracket includes:

a first connector connected to the outboard motor body; and a second connector below the first connector and connected to the outboard motor body; and at least a portion of the bearing housing is between the first connector and the second connector in the vertical direction.

* * * * *